US007455759B2

(12) United States Patent
Saito et al.

(10) Patent No.: US 7,455,759 B2
(45) Date of Patent: Nov. 25, 2008

(54) METHOD FOR PRODUCTION OF A STRUCTURE WITH PORES BY ANODIZING

(75) Inventors: Tatsuya Saito, Ebina (JP); Aya Imada, Yokohama (JP); Tohru Den, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 10/543,375

(22) PCT Filed: Aug. 10, 2004

(86) PCT No.: PCT/JP2004/011726

§ 371 (c)(1),
(2), (4) Date: Jul. 26, 2005

(87) PCT Pub. No.: WO2005/014893

PCT Pub. Date: Feb. 17, 2005

(65) Prior Publication Data

US 2006/0194433 A1 Aug. 31, 2006

(30) Foreign Application Priority Data

Aug. 11, 2003 (JP) ..... 2003-291522
Mar. 23, 2004 (JP) ..... 2004-085013

(51) Int. Cl.
*C25D 11/04* (2006.01)
*C23C 28/00* (2006.01)

(52) U.S. Cl. ..... 205/190; 205/175; 205/205; 205/206; 205/324; 205/325

(58) Field of Classification Search ..... 205/205, 205/206, 324, 325, 175, 190
See application file for complete search history.

(56) References Cited

U.S. PATENT DOCUMENTS 5,087,330 A * 2/1992 Wada et al. ..... 205/75

(Continued)

FOREIGN PATENT DOCUMENTS

DE 102 07 952 A1 9/2003

(Continued)

OTHER PUBLICATIONS

Hideki Masuda et al., "Fabrication of Gold Nanodot Array Using Anodic Porous Alumina as an Evaporation Mask," *Jpn. J. Appl. Phys.*, vol. 35, 1996, pp. L126-L129.

(Continued)

*Primary Examiner*—Susy N Tsang-Foster
*Assistant Examiner*—William T Leader
(74) *Attorney, Agent, or Firm*—Fitzpatrick, Cella, Harper & Scinto

(57) ABSTRACT

An anodized coating suitable for formation of highly regulated pores is provided. A method for production of a structure having pores characterized by including the steps of: forming starting points at predetermined intervals in an aluminum alloy formed on a substrate, and forming pores by anodization with the starting points as origins. In another embodiment, first and second aluminum alloy layers are anodized to form pores penetrating into the layers, wherein a diameter of a pore in the first alloy is different from a diameter of a pore in the second alloy. In an additional embodiment, a substrate is anodized to form pores, wherein the substrate contains an additive which changes the diameter within each pore, the amount of the additive continuously changing along the direction perpendicular to the substrate.

8 Claims, 6 Drawing Sheets

U.S. PATENT DOCUMENTS

| | | | | |
|---|---|---|---|---|
| 5,089,092 | A * | 2/1992 | Wada et al. | 205/75 |
| 5,917,198 | A * | 6/1999 | Maeda | 257/59 |
| 6,027,629 | A * | 2/2000 | Hisamoto et al. | 205/50 |
| 6,139,713 | A | 10/2000 | Masuda et al. | 205/206 |
| 6,214,738 | B1 | 4/2001 | Aiba et al. | 438/707 |
| 6,348,403 | B1 * | 2/2002 | Raina et al. | 438/618 |
| 6,476,409 | B2 | 11/2002 | Iwasaki et al. | 257/13 |
| 6,541,386 | B2 | 4/2003 | Aiba et al. | 438/707 |
| 6,784,007 | B2 * | 8/2004 | Iwasaki et al. | 438/22 |
| 6,878,634 | B2 | 4/2005 | Imada et al. | 438/700 |
| 6,914,008 | B2 * | 7/2005 | Den et al. | 438/707 |
| 7,070,855 | B2 | 7/2006 | Fukutani et al. | 428/312.2 |
| 7,074,480 | B2 | 7/2006 | Fukutani et al. | 428/312.2 |
| 2003/0020060 | A1 | 1/2003 | Iwasaki et al. | 257/13 |
| 2005/0167852 | A1 | 8/2005 | Imada et al. | 257/779 |
| 2006/0054507 | A1 | 3/2006 | Imada et al. | 205/206 |
| 2006/0112466 | A1 | 5/2006 | Den | 977/762 |
| 2006/0128155 | A1 | 6/2006 | Miyata et al. | 438/694 |
| 2006/0192309 | A1 | 8/2006 | Fukutani te al. | 264/1.21 |

FOREIGN PATENT DOCUMENTS

| | | |
|---|---|---|
| JP | 10-121292 | 5/1998 |

OTHER PUBLICATIONS

Masuda et al., *Jpn. J. Appl. Phys.*, vol. 31, No. 5, pp. 493-499 (1996).

* cited by examiner

METHOD FOR PRODUCTION OF A STRUCTURE WITH PORES BY ANODIZING

TECHNICAL FIELD

The present invention relates to a method for production of a porous nanostructure having pores with anodized alumina and a porous member.

BACKGROUND ART

When a voltage is applied to a treatment object (the treatment object is anodized) in an acidic solution with the treatment object as an anode, an anodized coating having nanoscale-sized pores is formed.

For example, when an aluminum substrate is anodized in an acidic electrolyte such as sulfuric acid, oxalic acid and phosphoric acid, a porous anodized coating is formed (see Non-Patent Document 1, etc.). The characteristic of this porous coating is that it has a specific geometric structure in which very small columnar pores (alumina holes) with the diameter of several nm to several hundreds of nm are arranged in parallel with the space of several tens of nm to several hundreds of nm. The columnar pore has a high aspect ratio and is excellent in uniformity of diameters of cross sections.

The structure of the porous coating can be controlled to some extent by changing conditions for anodization. For example, it is known that to some extent, the pore-to-pore space can be controlled with the anodization voltage, the depth of the pore can be controlled with anodization time, and the pore diameter can be controlled by pore-widening treatment. The pore-widening treatment is an etching treatment of alumina, and a wet etching treatment with phosphoric acid is usually used.

A method of carrying out two-step anodization for improving verticality, linearity and independency of pores of a porous coating is known. That is, a method of temporarily removing a porous coating formed by anodization, and then carrying out anodization again to form a porous coating having pores having better verticality, linearity and independency is proposed (see Japanese Journal of Applied Physics, Vol. 35, p. 126-129 (1996)). This method uses the fact that dents of an aluminum substrate formed at the time of removing an anodized coating formed by first anodization become pore formation starting points in second anodization.

A method using a stamper having protrusions for forming pores arranged in a desired pattern with high regularity is known (see Japanese Patent Application Laid-Open No. H10-121292; and Masuda, Kotai-Butsuri (Solid Physics), 31, p. 493 (1996)). In this method, the stamper is pressed against the surface of an aluminum substrate to transfer protrusions of the stamper to the surface of the aluminum substrate as dents, whereby pore formation starting points in anodization are prepared.

Nanostructures formed naturally, i.e., formed in a self-regulating manner, as described above, have a potential for achieving a fine and specific structure exceeding conventional artificial nanostructure techniques such as photolithography, electron beam exposure and X-ray exposure, and thus have received enormous attention in recent years.

Particularly, it is believed that by combining techniques for arranging pores regularly, techniques for filling metals, semiconductors and the like in pores, and the like, various nanodevices such as magnetic recording media, magnetic sensors, EL light emitting devices and electroluminescence devices can be realized, and numerous studies are conducted.

In general, aluminum substrates have heavy irregularities, which may cause disturbances and defects in shapes of pores formed. Therefore, the substrates are often subjected to a surface treatment, such as electrolytic polishing. Deposited aluminum films often yield protrusions called hillocks, and have heavy irregularities due to grain boundaries, which may cause disturbances and defects in shapes of pores formed.

However, since it is difficult to sufficiently flatten the surface of the aluminum substrate by electrolytic polishing, and a considerable thickness of aluminum is consumed, it is difficult to provide a thickness sufficient for electrolytic polishing in the case of deposited aluminum films.

Particularly, in the case where highly regulated pores are formed using a stamper, some of the protrusion portions of the stamper are not transferred due to raised portions, such as hillocks. As a result, it may be impossible to form highly regulated pores uniformly. That is, as shown in the schematic diagram of the cross-section of a sample in FIGS. 1A and 1B, some protrusions 13 of the stamper 12 are not transferred as dents 14 due to hillocks 11 existing on the surface of the aluminum film 10. If anodization is carried out in this case, pores are randomly generated from an area 15 where dents are not transferred, resulting in formation of pores 20 having a partly disturbed arrangement 22 in comparison with orderly arrangement 21, as shown in the schematic diagram of the plane of a sample in FIG. 2.

If a metal or semiconductor is to be filled in pores obtained by anodization, various kinds of deposition methods such as a vapor deposition method and a CVD method, but an electrodeposition method is preferable in terms of capability of filling the material in pores having a high aspect ratio, and a Cu or precious metal layer is provided below an anodized coating as an electrode layer for electrodeposition.

However, if such an electrode layer is used, the strength of bonding between the electrode layer and the anodized coating is so weak that it is difficult to form pores extending through the electrode. That is, if anodization is carried out until the bottom of the pore reaches the electrode layer, the anodized coating may fall off. Thus, anodization is stopped before the pore reaches the electrode layer, and a partition wall called a barrier layer existing on the bottom of the pore is removed by chromic-acid based etching, or the like. In this case, there are some variations in the depth of the pore, and therefore it is difficult to stop anodization with good reproducibility with the barrier layer left uniformly over the entire area.

The present invention solves the above problems, and provides an anodized coating suitable for formation of highly regulated pores.

DISCLOSURE OF THE INVENTION

According to an aspect of the present invention, there is provided a method for fabricating a structure having pores, which comprises the steps of forming an aluminum alloy on a substrate, providing anodization starting points in a predetermined arrangement, and forming pores by anodization with the starting points as origins.

The aluminum alloy preferably contains at least one element selected from the group consisting of Ti, Zr, Hf, Nb, Ta, Mo and W.

The aluminum alloy preferably contains 50 to 95 atom % aluminum.

The surface of the substrate preferably has a layer of Cu or a noble metal.

According to another aspect of the present invention, there is provided a porous member wherein comprising oxides of aluminum and a bulb metal, the pores being arranged at regular intervals. The bulb metal contains at least one element selected from the group consisting of Ti, Zr, Hf, Nb, Ta, Mo and W.

According to the present invention, highly regulated pores by anodization can be formed with high accuracy, and an extremely wide range of applications of a porous anodized coating having a potential for becoming a base material of various kinds of nanodevices are realized.

According to a further aspect of the present invention, there is provided a method for fabricating a structure having pores, which comprises the steps of preparing a layered structure comprised of a first layer containing a first material enabling pores to be formed therein by anodization and a second layer containing a second material different from the first material in composition and enabling pores to be formed therein by anodization which layers are laminated, and anodizing the layered structure to form pores in the first and second layers which pores pass through both the layers. In the method, at least one of the first material and the second material is preferably comprised of an aluminum alloy. The aluminum alloy is preferably comprised of at least one kind of elements selected from the group consisting of Ti, Zr, Hf, Nb, Ta, Mo and W.

According to a further aspect of the present invention, there is provided a method for fabricating a structure having pores, which comprises the steps of preparing a substrate containing a material enabling pores to be formed therein when anodization is carried out, and anodizing the substrate to form pores in the substrate, the substrate containing an additive which changes the diameter of the pores in the substrate in an amount at every region of the substrate which amounts in the region are different from each other.

According to a further aspect of the present invention, there is provided a structure having pores passing therethrough and containing an aluminum alloy, diameters of the cross-sections of the pore in the direction of the pore's passing through the structure are different from one another. In the structure, the aluminum alloy is preferably comprised of at least one kind of elements selected from the group consisting of Ti, Zr, Hf, Nb, Ta, Mo and W.

BEST MODE FOR CARRYING OUT THE INVENTION

The embodiments of the present invention will be described in detail below.

The inventors conducted studies on a material having a higher level of flatness than an aluminum film and providing with good reproducibility a porous coating similar to an anodized coating of the aluminum film.

As a result, the inventors found that the above object could be achieved by alloying aluminum to inhibit occurrence of hillocks and using an alloy of aluminum and a bulb metal as an aluminum alloy.

For the method for fabrication of an alloy, various kinds methods can be considered, for example, a method of sputtering an aluminum target and a bulb metal target at a time, a sputtering method in which bulb metal chips are placed on an aluminum target, and a method with a sintered alloy target, but it is not specifically limited to these methods. Of course, a deposition method other than the sputtering method may be used.

At this time, by adding a bulb metal M (M=at least one selected from the group consisting of Ti, Zr, Hf, Nb, Ta, Mo and W) to aluminum Al in an amount of approximately 5 atom % or more, flatness of the surface of a sample is improved as compared with an aluminum film, and as the added amount is increased, flatness is still further improved because an amorphous alloy is formed. The flatness here refers to a degree of irregularities of the surface resulting from hillocks and the like, and is evaluated from the average value of RMS (root mean square) of the surface of a sample measured at a plurality of locations using an AFM (atomic force microscope).

However, if a level of an amorphous phase is reached, verticality and linearity of pores formed by anodization decrease and so on, so that it is difficult to obtain with good reproducibility a porous coating similar to anodized coating of an aluminum film, and therefore the bulb metal is preferably added in an amount of approximately 5 to 50 atom % depending on the type of bulb metal added.

If alloyed aluminum according to the present invention is used as an anodized coating, pores extending through an electrode can be formed with good reproducibility even if a Cu or precious metal layer is provided below the anodized coating as an electrode layer.

That is, it was found that the anodized film never falls off even if pores are formed through the electrode layer without leaving some barrier layer on the bottom of the pore.

Examples in which an alloy film of aluminum and a bulb metal fabricated as described above was used as an anodized coating will be described below.

EXAMPLE 1

This Example relates to examination of an aluminum tungsten alloy film with tungsten added to aluminum as an anodized coating.

Figure 1A:
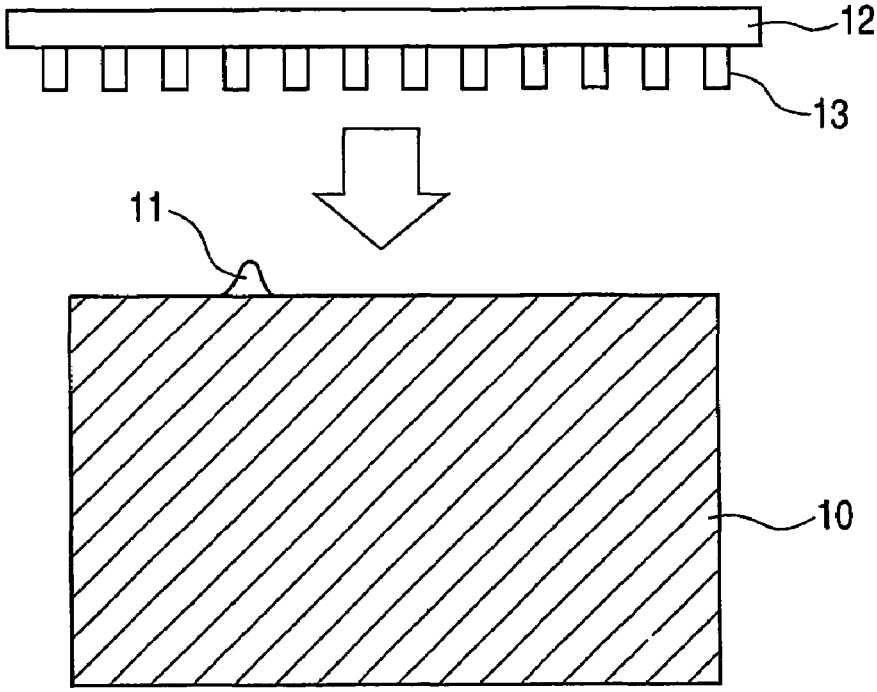
FIG. 1A is a schematic diagram when a stamper is pressed against an aluminum film.
Figure 1B:
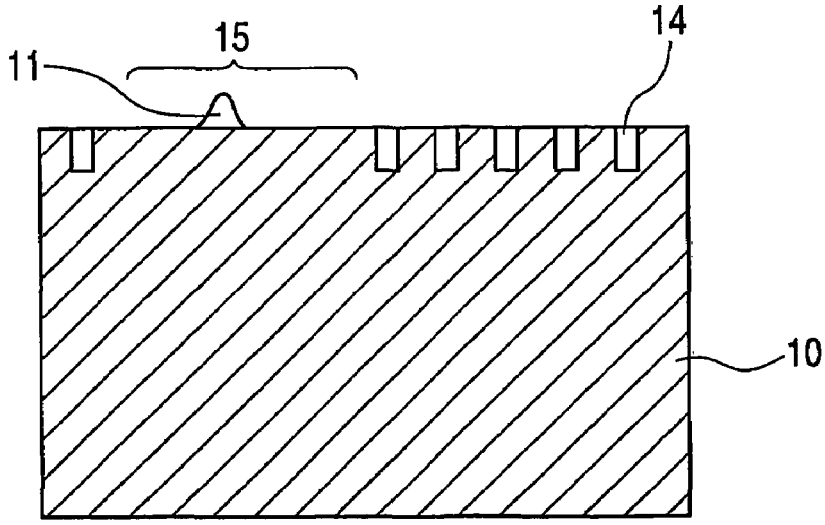
FIG. 1B is a schematic diagram of the aluminum film after protrusions of the stamper are transferred.
Figure 2:
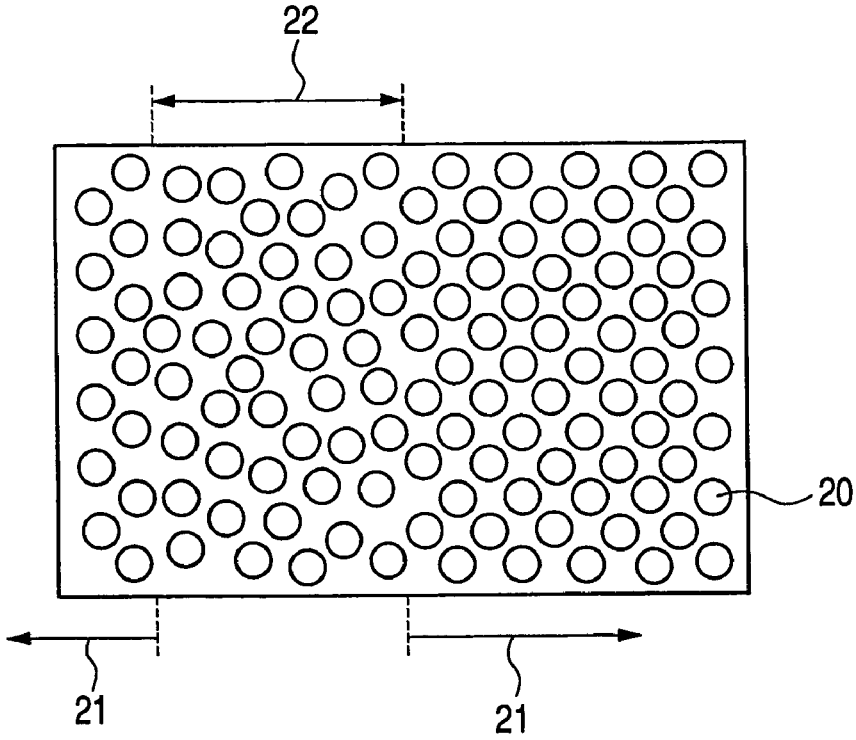
FIG. 2 is a schematic diagram of the surface of a sample after anodization.
Figure 3:
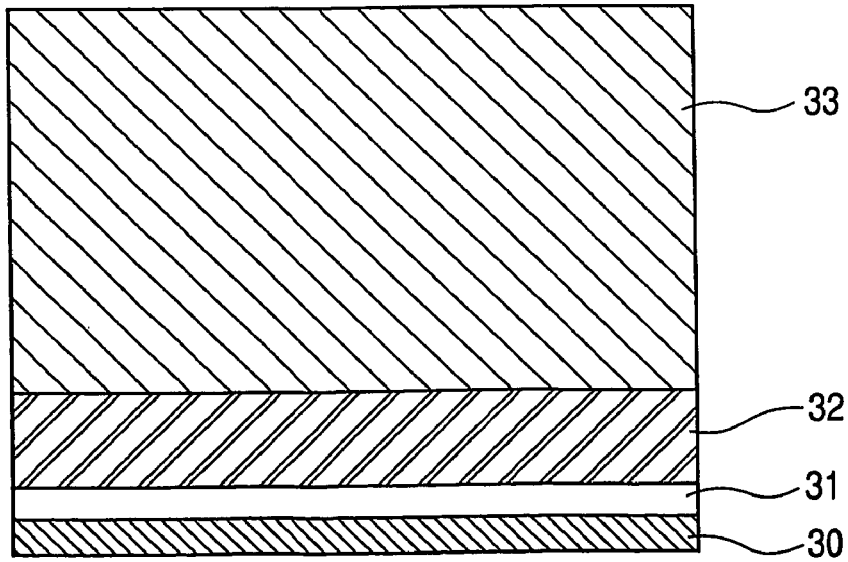
FIG. 3 is a schematic diagram of the cross section of a sample.

Samples having a configuration shown in FIG. 3 with 5 nm of Ti 31 deposited on a Si (100) substrate 30, 20 nm of Cu 32 deposited thereon, and 200 nm of aluminum tungsten alloy film 33 deposited thereon were prepared. The deposition was carried out by the sputtering method, and the aluminum tungsten alloy was deposited with tungsten chips of 20 mm square placed on an aluminum target having a diameter of 4 inches (101.6 mm). At this time, a plurality of samples having varied composition ratios of tungsten to aluminum by changing the number of tungsten chips was prepared.

First, the composition ratio of tungsten to aluminum was examined by X-ray fluorescence analysis (XRF) for all the samples prepared. Further, the surface of the sample was scanned at arbitrary 5 points with an AFM, and the degree of irregularities of the surface was evaluated from the average value of RMS.

The sample was anodized by application of a voltage of 40 V to the sample in a 0.3 mol/L aqueous oxalic acid solution at a bath temperature of 16° C. Thereafter, the surface and cross section of the sample after anodization were observed by a field emission scanning electron microscope (FE-SEM) to see shapes of formed pores, and the like. For samples subjected to a pore-widening treatment after anodization, observations were similarly made by FE-SEM. For the pore-widening treatment, wet etching was carried out by immersing the sample in a 5 wt % aqueous phosphoric acid solution at room temperature for 30 minutes. The results are shown in Table 1, wherein symbols A, B and C mean good, fair and bad, respectively.

TABLE 1

| Sample | A0 | B0 | C0 | D0 | E0 |
|---|---|---|---|---|---|
| Composition ratio/ atom % | 3.5 | 5.5 | 11.0 | 16.2 | 23.1 |
| RMS/nm | 5.32 | 1.16 | 1.01 | 0.15 | 0.10 |
| Pores after anodization | A | A | A | B | B |
| Pores after pore-widening treatment | A | A | A | B | C |

RMS decreased as the composition ratio of tungsten to aluminum increased, and extremely decreased between samples C0 and D0. These samples were measured by X-ray diffraction (XRD) and as a result, a peak by (111) of aluminum was clearly observed around 2θ=38° in samples A0 to C0, while the peak was not observed but a broad state was recognized in the sample D0. From this result, it can be considered that a crystal structure in the sample D0 changed into an amorphous structure, resulting in a considerable decrease in RMS.

Figure 4:
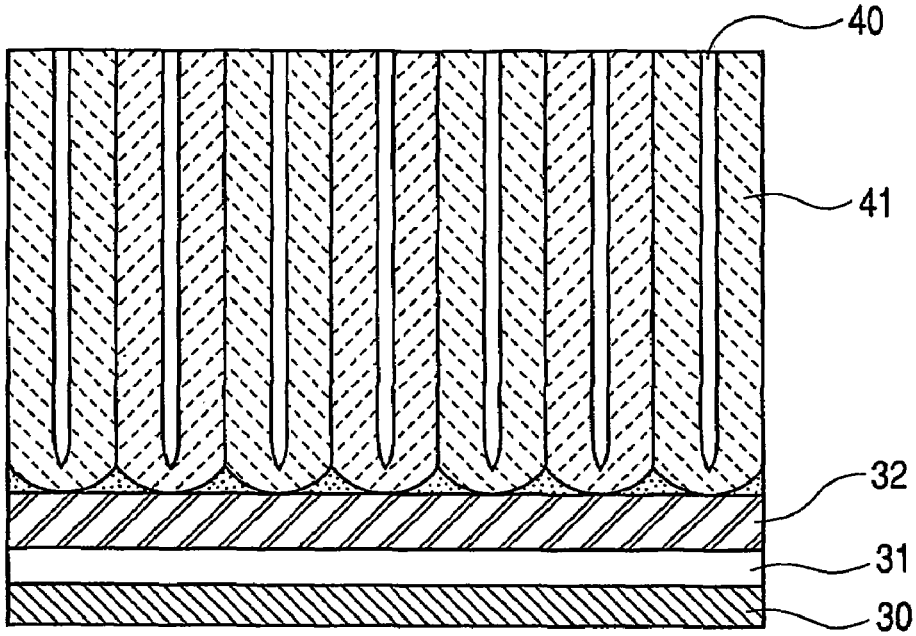
FIG. 4 is a schematic diagram of the cross section of a sample after anodization for samples A0 to C0.
Figure 5:
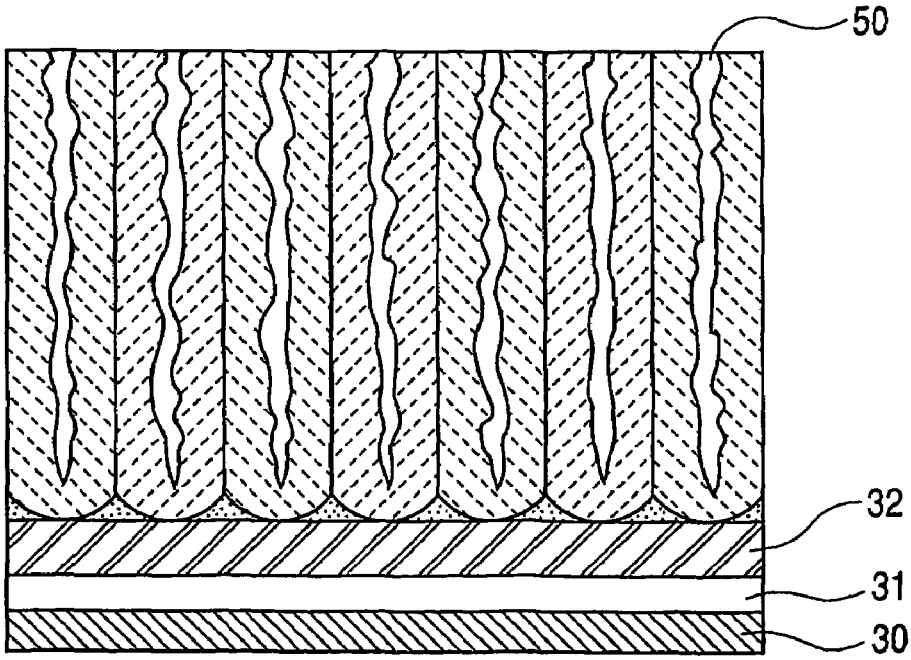
FIG. 5 is a schematic diagram of the cross section of a sample after anodization for samples D0 and E0.
Figure 6:
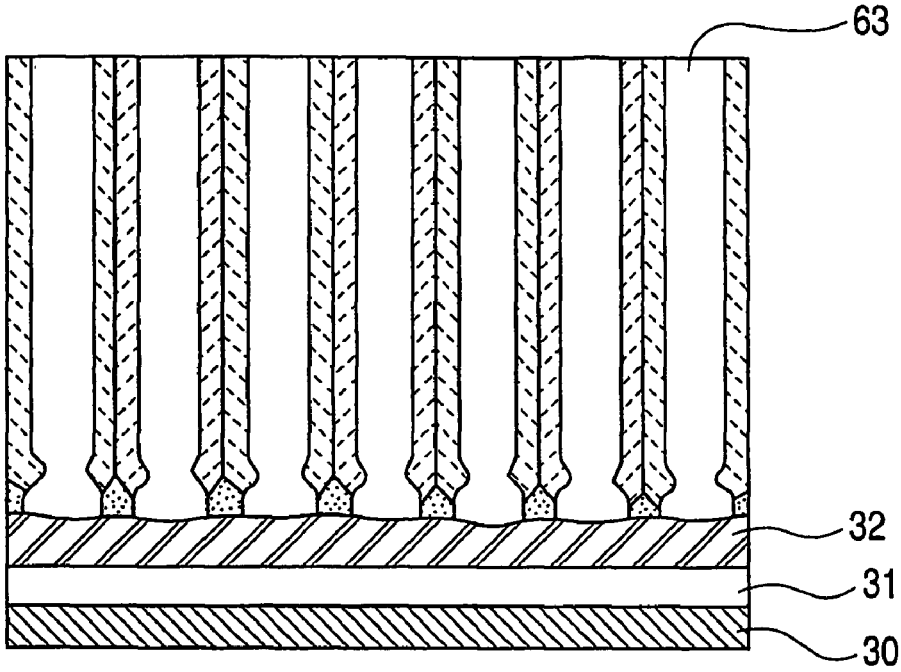
FIG. 6 is a schematic diagram of the cross section of a sample after a pore-widening treatment for samples A0 to C0.
Figure 7:
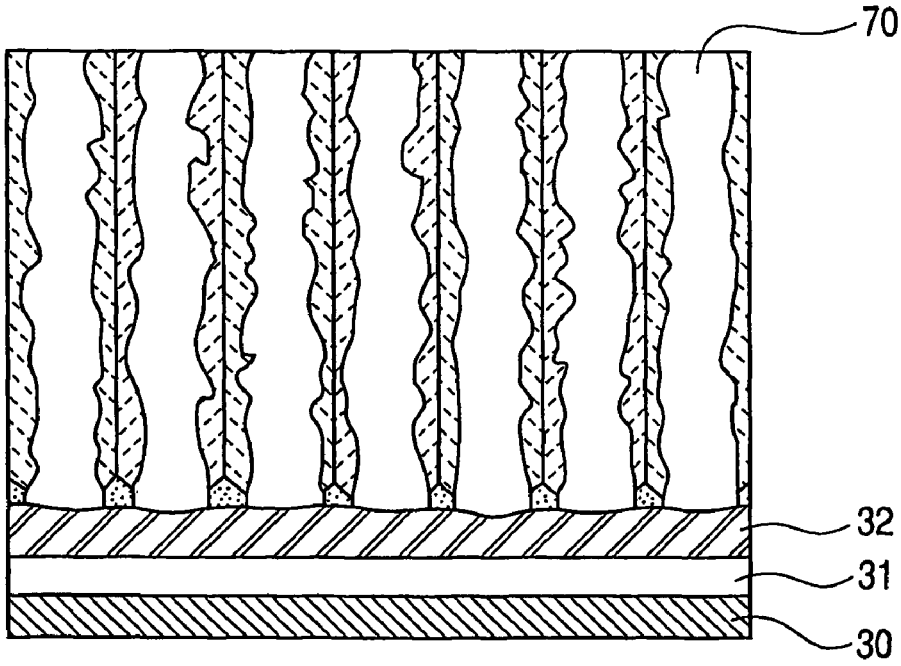
FIG. 7 is a schematic diagram of the cross section of a sample after the pore-widening treatment for samples D0 and E0.

The cross section of the sample after anodization was observed by FE-SEM and as a result, it was found that pores 40 having good linearity were partitioned by partition walls 41 as shown in FIG. 4 in samples A0 to C0, while the state of walls of pores was so poor that the linearity of pores 50 decreased as shown in FIG. 5 in samples D0 and E0. For samples subjected to the pore-widening treatment after anodization, the cross section was similarly observed by FE-SEM and as a result, it was found that the linearity was good with the pore diameter increased, and pores 63 extending through Cu 62 being an under layer were formed as shown in FIG. 6 in samples A0 to C0. In the sample D0, the pore diameter was increased, but pores 70 were poor in linearity as shown in FIG. 7. In the sample E0, the partition wall between pores was extremely thin, and some parts were no longer porous.

As a Comparative Example, an aluminum chromium alloy film with chromium added to aluminum was examined in the same manner. In this case, if the composition ratio of chromium to aluminum exceeded 5 atom %, chromium in the aluminum chromium alloy film started to dissolve at the instant when the sample was immersed in an acidic solution for use in anodization, and a porous anodized coating could not be obtained. If the composition ratio of chromium was around 1 atom %, the above situation did not occur, and a porous anodized coating could be obtained, but the added amount of chromium was so small that RMS was not improved.

According to this Example, tungsten can be added to aluminum in an amount of approximately up to 15 atom % if an alloy with tungsten added to aluminum is used as an anodized coating. For improving the flatness of the surface, a certain amount of tungsten should be added and in view of these considerations, it is preferable that tungsten is added to aluminum in an amount of approximately 5 to 15 atom %.

EXAMPLE 2

This Example relates to examination of an aluminum titanium alloy film with titanium added to aluminum as an anodized coating. Particularly, it relates to examination in which the composition ratio of titanium to aluminum was increased to determine a maximum composition ratio allowing a porous anodized coating to be obtained.

5 nm of Ti was deposited on an Si (100) substrate, 20 nm of Cu was deposited thereon, and 200 nm of aluminum titanium alloy film was deposited thereon in the same manner as Example 1. The aluminum titanium alloy was deposited with titanium chips of 20 mm square placed on an aluminum target having a diameter of 4 inches (101.6 mm). At this time, a plurality of samples having varied composition ratios of titanium to aluminum by changing the number of titanium chips was prepared.

The sample was anodized by application of a voltage of 10 V to the sample in a 5 mol/L aqueous sulfuric acid solution at a bath temperature of 3° C. Thereafter, the surface and cross section of the sample after anodization were observed by FE-SEM to see shapes of formed pores, and the like. For samples subjected to a pore-widening treatment after anodization, observations were similarly made by FE-SEM. For the pore-widening treatment, wet etching was carried out by immersing the sample in a 5 wt % aqueous phosphoric acid solution at room temperature for 30 minutes.

As a result, it could be recognized that a porous anodized coating can be obtained as long as the composition ratio of titanium to aluminum is up to approximately 50 atom %.

EXAMPLE 3

This Example relates to formation of highly regulated pores using the aluminum tungsten alloy film fabricated in Example 1.

A stamper having protrusions was pressed against samples A0 and C0 fabricated in Example 1 to transfer protrusion portions to the surface of the sample. The stamper had protrusions with the height of 30 nm arranged in a honeycomb form with the space of 100 nm, and was fabricated by electron beam exposure of SiC.

Subsequently, the surface of the sample was observed at a plurality of arbitrary locations by an FE-SEM. In sample A0, there were areas where protrusion portions of the stamper were accurately transferred, but areas where protrusions were not transferred were observed at many locations. Further, it could be found that in these areas, relatively large irregularities considered as hillocks and grain boundaries of aluminum existed. The sample was scanned at a plurality of arbitrary locations by an AFM. As a result, it was found that dents with the depth almost matching the height of protrusions were arranged in a honeycomb form in the area where protrusions were transferred, but objects like foreign matter with the height of about 30 nm existed on the substrate in the area where protrusions were not transferred, and the objects can be considered as hillocks and grain boundaries of aluminum. In sample C0, areas where dents were not transferred as described previously and objects like foreign matter did not exist in all the areas were observed.

Further, each sample was anodized and subjected to a pore-widening treatment under the same conditions as in Example 1, and then the surface of the sample was observed at a plurality of arbitrary locations by FE-SEM. As a result, in the sample A0, there were areas where pores were arranged in a honeycomb form, but pores were randomly formed in areas where it could be considered that protrusions of the stamper were not transferred before anodization. In the sample C0, pores were arranged in a honeycomb form in all areas, and pores matching the arrangement of protrusions of the stamper were formed over the entire surface.

From the results described above, it is shown that in the case where a stamper is used to form highly regulated pores by anodization, use of the aluminum tungsten alloy film according to the present invention is very effective for formation of regularly arranged pores with high accuracy.

EXAMPLE 4

This Example relates to formation of highly regulated pores using the aluminum tungsten alloy film fabricated in Example 1. Particularly, it relates to formation of pores by providing starting points of anodization in a predetermined arrangement and carrying out anodization with the starting points as origins.

For samples A0 and C0 fabricated in Example 1, 50 nm of an aluminum alkoxide was coated to the surface of the sample by the spin coating method.

Subsequently, the sample was baked at 80° C. for 10 minutes, and then a stamper was pressed against the alkoxide surface to transfer protrusion portions of the stamper to the alkoxide surface. In this Example, a stamper having protrusions with the height of 100 nm, arranged in a triangle lattice form with the space of 160 nm was used. Thereafter, the alkoxide surface was scanned at a plurality of arbitrary locations by an AFM. As a result, it was found that in the sample C0, protrusions of the stamper were transferred to the alkoxide surface as dents of about 30 nm for all the scanned areas. In the sample A0, on the other hand, areas where protrusions were not transferred, and areas where protrusions were transferred but dents were uneven in depth, existed, and it can be considered that in these areas, hillocks and grain boundaries exist as described in Example 3. That is, it can be considered that the alkoxide coated on aluminum reflects irregularities by hillocks and grain boundaries so that transfer unevenness occurs, and as a result, protrusions are not transferred, or dents are uneven in depth.

Further, the sample was treated by ashing using ultraviolet light and ozone at 150° C. for 10 minutes, whereby some of polymers in the alkoxide were removed, and at the same time, the oxidation of the aluminum part was advanced to oxidize the alkoxide layer.

Thereafter, the sample was anodized by application of a voltage of 64 V to the sample in a 0.3 mol/L aqueous phosphoric acid solution at a bath temperature of 18° C. and as a result, the oxidized alkoxide layer and aluminum layer were collectively anodized, and formation of pores could be recognized for both samples A0 and C0 by observation of the cross section of the sample by an FE-SEM.

After anodization, the sample was subjected to a pore-widening treatment by immersing the sample in the 0.3 mol/L aqueous phosphoric acid solution at room temperature for 60 minutes, and then the surface of each sample was observed at a plurality of locations by FE-SEM. As a result, in the sample A0, there were areas where pores arranged in a triangle lattice form were formed, but pores with impaired regularity were formed in areas where it could be considered that the unevenness of the transfer to the alkoxide occurred as described previously. In the sample C0, on the other hand, pores arranged in a triangle lattice form matching the arrangement of protrusions of the stamper were formed in all the areas observed.

From the results described above, it is shown that in the case where pores are formed by providing starting points of anodization in a predetermined arrangement and carrying out anodization with the starting points as origins, use of the aluminum tungsten alloy film according to the present invention is effective for formation of regularly arranged pores with high accuracy.

EXAMPLE 5

This Example relates to examination on variation depending on the type of element added to aluminum for the diameter of pores obtained after anodization.

First, a sample with Ti deposited in the thickness of 10 nm on an n-Si (001) substrate and an aluminum alloy film deposited thereon in the thickness of 200 nm was fabricated by the sputtering method. The deposition of the aluminum alloy film was carried out with chips of an added element placed on an aluminum target. At this time, the deposited aluminum alloy film was quantitatively analyzed by XRF analysis and ICP to examine variation in composition ratio for the size and number of chips so that an aluminum alloy thin film having a desired composition ratio could be obtained. Seven types of aluminum alloy films containing 5 atom % of Ti, Zr, Hf, Nb, Ta, Mo and W, respectively, as added elements, were fabricated.

Then, the sample was anodized by application of a voltage of 40 V to the sample in a 0.3 mol/L aqueous oxalic solution at a bath temperature of 16° C. After anodization, the sample was immersed in a 0.3 M aqueous phosphoric acid solution at a bath temperature of 22.5° C. for 30 minutes to carry out a pore-widening treatment. As a Comparative Example, similar experiments were conducted for the case of use of an aluminum film. The plane and sectional shapes of the sample after the pore-widening treatment were observed by an FE-SEM to determine the average diameter of formed pores. The results are shown in Table 2.

TABLE 2

| Sample name | A1 | B1 | C1 | D1 | E1 | F1 | G1 | H1 |
|---|---|---|---|---|---|---|---|---|
| Added element | Ti | Zr | Hf | Nb | Ta | Mo | W | — |
| Pore diameter after pore-widening treatment/nm | 40 | 35 | 25 | 50 | 50 | — | 70 | 60 |

For the sample H1, the aluminum film fabricated as a Comparative Example was used. For the pore diameter after the pore-widening treatment, samples can be broadly classified into the sample G1 having a pore diameter lager than that of the sample H1 and samples A1 to E1 each having a pore diameter smaller than that of the sample H1. In the sample F1, the pore diameter could not be determined because the anodized coating was dissolved and thus eliminated after the pore-widening treatment.

From the results of Table 1, it can be considered that in samples A1 to E1, an oxide of an added element was contained in the anodized coating and as a result, resistance of the coating to acid was improved, so that growth in the pore diameter after the pore-widening treatment was inhibited compared to the anodized coating of aluminum of the sample H1. It can be considered that in samples F1 and G1, an oxide of an added element was contained in the coating and as a result, resistance of the coating to acid was reduced, so that growth in the pore diameter after the pore-widening treatment was promoted compared to the sample H1. Particularly, in the sample F1, existence of the coating and pores could be recognized in an FE-SEM image just after anodization, but the coating was fully dissolved after the pore-widening treatment, and therefore it can be considered that resistance to acid was extremely reduced.

It could be recognized that in the sample F1, the pore diameter just after anodization was about 15 nm, which was slightly larger than the pore diameter: 10 nm in the sample H1 just after anodization, but the pore diameter in other samples was about 10 nm, which was not significantly different from the pore diameter in the sample H1.

As described above, it is indicated that by selecting the type of element added to aluminum, the diameter of pores obtained by anodization can be controlled, and it is shown that the elements are broadly classified into added elements (Mo and W) providing a pore diameter larger than the pore diameter obtained by anodization of aluminum and added elements (Ti, Zr, Hf, Nb and Ta) providing a pore diameter smaller than the pore diameter obtained by anodization of aluminum.

EXAMPLE 6

This Example relates to examination on the shape of pores after anodization associated with the type of element added to aluminum. Particularly, it relates to variation in added amount for Example 5.

First, samples were fabricated by the sputtering method in the same manner as in Example 5. In this Example, 7 types of aluminum alloy films containing 10 atom % of any one of Ti, Zr, Hf, Nb, Ta, Mo and W, respectively, as added elements were fabricated.

Then, the sample was anodized and subjected to a pore-widening treatment in the same manner as in Example 5, and the plane and sectional shapes of the sample after the pore-widening treatment were observed by an FE-SEM to determine the average pore size of formed pores. The results are shown in Table 3.

TABLE 3

| Sample name | I1 | J1 | K1 | L1 | M1 | N1 | O1 |
|---|---|---|---|---|---|---|---|
| Added element | Ti | Zr | Hf | Nb | Ta | Mo | W |
| Pore diameter after pore-widening treatment/nm | 30 | 25 | 15 | 40 | 40 | — | 90 |

The same tendency as in Example 5 is shown for the pore diameter after the pore-widening treatment, wherein the pore diameter is smaller than the pore diameter in the sample H1 of Example 5 in samples I1 to M1, and the difference in pore diameter is significant compared to Example 5. In the sample N1, the anodization coating was fully dissolved and thus eliminated after the pore-widening treatment, and therefore the pore diameter could not be determined as in the case of the sample F1 of Example 5. In the sample O1 , the pore diameter is about 90 nm, and a partition wall between neighboring pore diameters are dissolved at several locations, and it is conceivable that the anodized coating could be fully dissolved if the pore-widening treatment is further carried out.

Comparison of Example 5 with this Example showed that the diameter of the pores obtained by anodization varied depending not only on the type of the element added to aluminum, but also on the amount of the added element. The difference in the pore diameter obtained by anodization of aluminum became significant as the amount of the added element increased.

Hf was selected as an added element expected to cause a significant change in pore diameter even with a small added amount, and the added amount of Hf was reduced compared to Example 5 to conduct a similar examination. As a result, it was found that in an aluminum alloy film containing Hf in an amount of 1 atom % or more, pores smaller in diameter than pores obtained by anodization of aluminum could be obtained, and that pores could be almost the same as those obtained by anodization of aluminum when the added amount was less than 1 atom %.

The upper limit of the added amount was examined similarly. As a result, it is desirable that the added amount should be generally 50 atom % or less in the case of, for example, Ti, Zr and Hf, in terms of obtaining a porous coating having pores excellent in linearity and verticality by anodization, although the value varies depending on the anodization conditions and the added element. In the case of W, dissolution of the anodized coating becomes significant as the added amount increases, and therefore the added amount is preferably 20 atom % or less, more preferably 15 atom % or less.

The sample can be used in a filter or the like by peeling off the substrate.

EXAMPLE 7

This example relates to pores formed by stacking aluminum alloy films having different compositions. Particularly, it relates to formation of pores having constricted parts and swelled parts.

Figure 8:
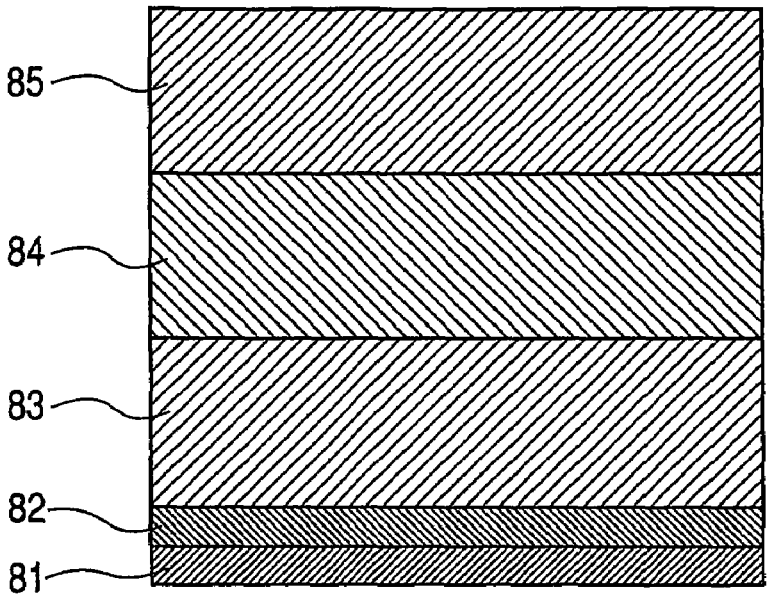
FIG. 8 is a schematic diagram of a sample having aluminum alloy films stacked in three layers.
Figure 9:
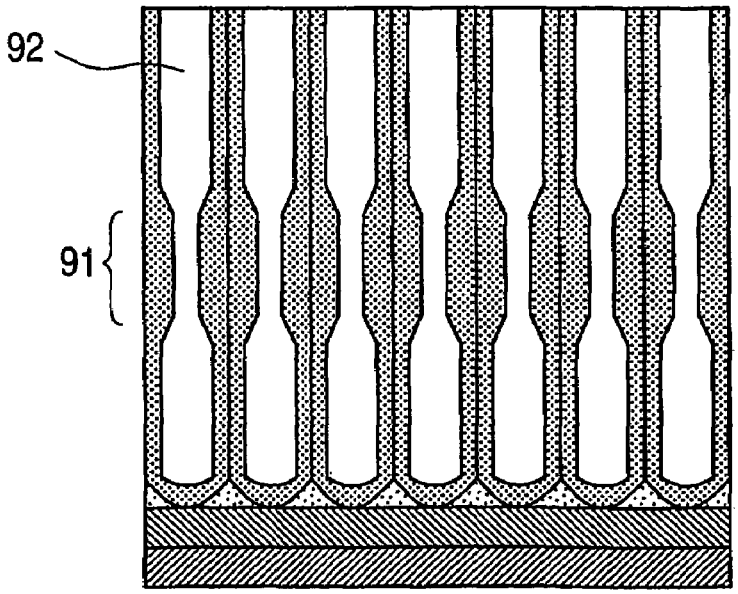
FIG. 9 schematically shows the cross section of a sample after anodization.

First, a sample shown in FIG. 8 with Ti 82 deposited in the thickness of 10 nm on an n-Si (100) substrate 81, an aluminum tungsten alloy film 83 deposited thereon in the thickness of 100 nm, an aluminum hafnium alloy film 84 deposited thereon in the thickness of 100 nm, and the aluminum tungsten alloy film 85 deposited thereon in the thickness of 100 nm was fabricated. At this time, for the amount of each element added, the aluminum tungsten alloy film contains 10 atom % of W, and the aluminum hafnium alloy film contains 5 atom % of Hf.

Subsequently, the prepared sample was anodized by application of a voltage of 25 V to the sample in a 0.3 mol/L aqueous sulfuric acid solution at a bath temperature of 10° C. Further, after anodization, the sample was immersed in a 0.3 M aqueous phosphoric acid solution at a bath temperature of 22.5° C. for 20 minutes to carry out a pore-widening treatment.

The cross section of the sample after the pore-widening treatment was observed by an FE-SEM. As a result it was found that pores 92 having constricted parts 91. Pores formed from the aluminum tungsten alloy film each had a diameter of about 50 nm. Pores formed from the aluminum hafnium alloy film each had a diameter of about 20 nm. The pores formed at this time were excellent both in linearity and verticality, and branching of pores and the like was not observed even in the vicinity of the interface between layers.

Figure 10:
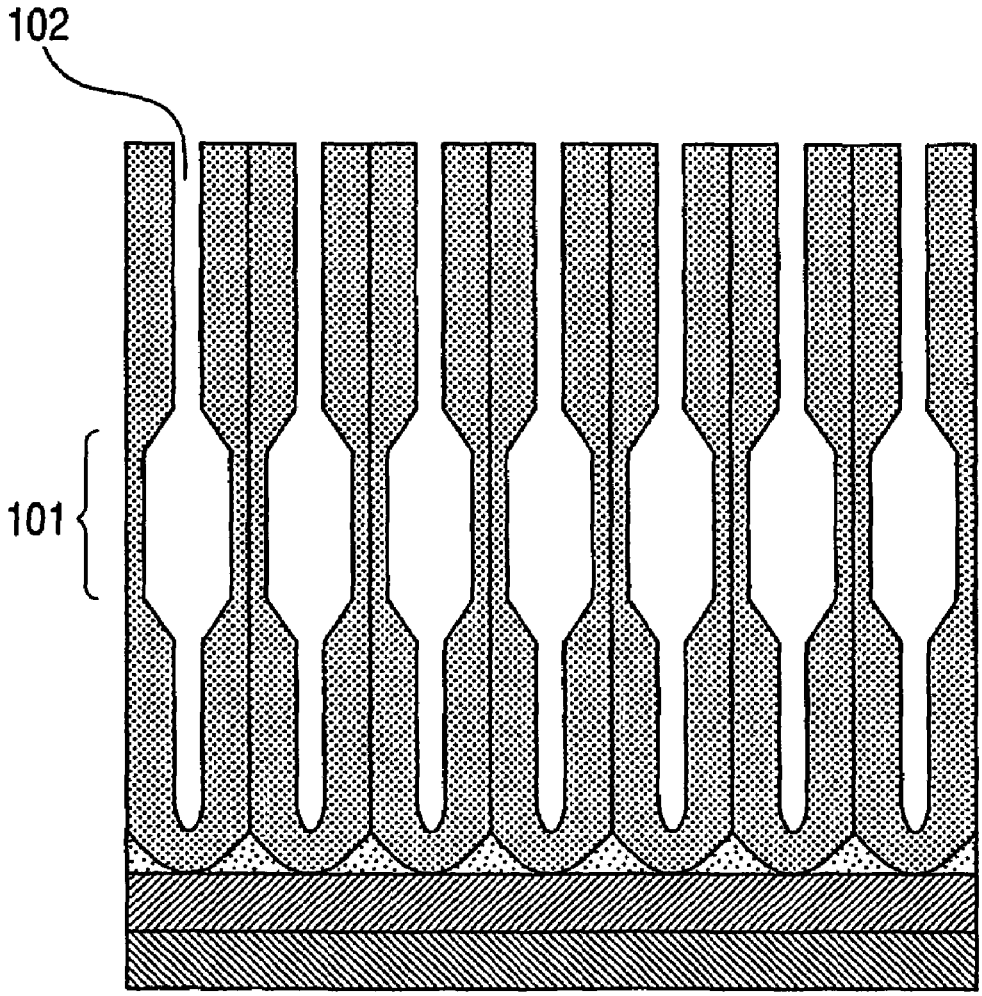
FIG. 10 schematically shows the cross section of a sample after anodization.

The above three-layer structure was fabricated such that the aluminum hafnium alloy films were placed above and below the aluminum tungsten alloy film, and similar examination was conducted and as a result, it was found that pores 102 having swelled parts 101 shown in FIG. 10 were formed.

From the above results, it is shown that pores having constricted parts and swelled parts can be formed using variation in pore diameter with the added alloy element.

EXAMPLE 8

10 nm of Pt and 10 nm of Ti were deposited on an n-Si (100) substrate, and experiments were conducted in the same manner as in Example 7 to obtain a structure similar to that of Example 7. Further, the obtained structure was immersed in a nickel electroplating bath, and Ni was electrodeposited using as a negative electrode Pt exposed on the bottom of the pore. Not only Ni but also magnetic materials, light emission materials and the like can be filled in pores, and application to magnetic recording media and optical elements is possible.

This application claims priorities from Japanese Patent Applications No. 2003-291522 filed on Aug. 11, 2003 and No. 2004-085013 filed on Mar. 23, 2004, which are hereby incorporated by reference herein.

The invention claimed is:

1. A method for fabricating a structure having pores, which comprises the steps of:

forming a first aluminum alloy on a substrate;

forming a second aluminum alloy on the first aluminum alloy; and forming pores penetrating into the first aluminum alloy and the second aluminum alloy by anodization, wherein a first diameter of a pore in the first aluminum alloy is different from a second diameter of the pore in the second aluminum alloy.

2. The method according to claim 1, wherein each aluminum alloy contains at least one element selected from the group consisting of Ti, Zr, Hf, Nb, Ta, Mo and W.

3. The method according to claim 1, wherein the surface of the substrate has a layer of Cu or a noble metal.

4. The method according to claim 1, wherein the first diameter is larger than the second diameter.

5. The method according to claim 1, further comprising a step of forming a third aluminum alloy on the second aluminum alloy.

6. A method for fabricating a structure having pores, which comprises the steps of:

preparing a layered structure comprised of a first layer containing a first aluminum alloy, which contains no more than 15 atom % of another element, and a second layer containing a second aluminum alloy, which contains no more than 15 atom % of another element, different from the first aluminum alloy in composition; and anodizing the layered structure to form pores in the first and second layers which pores pass through both the layers.

7. The method according to claim 6, wherein each aluminum alloy is comprised of at least one element selected from the group consisting of Ti, Zr, Hf, Nb, Ta, Mo and W.

8. A method for fabricating a structure having pores, which comprises the steps of:

preparing a substrate containing a material enabling pores to be formed therein when anodization is carried out; and anodizing the substrate to form pores in the substrate, wherein the substrate contains an additive which changes the diameter within each pore in the substrate, and an amount of the additive is continuously changing along the direction which is perpendicular to the substrate.

* * * * *